US007426841B2

(12) United States Patent
Yang

(10) Patent No.: US 7,426,841 B2
(45) Date of Patent: Sep. 23, 2008

(54) LOCK HAVING SLIDABLE BOX

(76) Inventor: Yao-Kun Yang, No. 101, Lane 93, Chang Lu Road, Chang Hua City (TW)

( * ) Notice: Subject to any disclaimer, the term of this patent is extended or adjusted under 35 U.S.C. 154(b) by 0 days.

(21) Appl. No.: 11/600,735

(22) Filed: Nov. 17, 2006

(65) Prior Publication Data

US 2008/0115544 A1 May 22, 2008

(51) Int. Cl.
*E05B 65/52* (2006.01)

(52) U.S. Cl. ..... 70/63; 70/25; 70/26; 70/456 R; 109/47

(58) Field of Classification Search ..... 70/63, 70/456 R, 54–56, 459, 460, 21, 25, 26, 30, 70/38 A, 38 C, 388; 24/3.6; 109/23, 47, 109/50–54; 206/37.1–37.5, 37.8, 38.1; 248/551–553
See application file for complete search history.

(56) References Cited

U.S. PATENT DOCUMENTS

| | | | | | |
|---|---|---|---|---|---|
| 1,613,813 | A * | 1/1927 | Westland | 232/4 R |
| 1,955,809 | A * | 4/1934 | Hobbs | 109/23 |
| 2,995,025 | A * | 8/1961 | Toepfer | 70/58 |
| 3,695,067 | A * | 10/1972 | Bays | 70/63 |
| 3,800,576 | A * | 4/1974 | Barrett et al. | 70/302 |
| 3,895,505 | A * | 7/1975 | Wasserfaller | 70/111 |
| 3,979,932 | A * | 9/1976 | Piche | 70/63 |
| 4,325,240 | A * | 4/1982 | Gable | 70/284 |
| 4,398,470 | A * | 8/1983 | Williams et al. | 109/52 |
| 4,649,723 | A * | 3/1987 | Appelbaum | 70/63 |
| 4,838,052 | A * | 6/1989 | Williams et al. | 70/63 |
| 4,869,082 | A * | 9/1989 | Appelbaum | 70/63 |
| 5,090,222 | A * | 2/1992 | Imran | 70/63 |
| 5,134,869 | A * | 8/1992 | Gable | 70/63 |
| 5,245,652 | A * | 9/1993 | Larson et al. | 379/102.06 |
| 5,531,082 | A * | 7/1996 | Wolk et al. | 70/63 |
| 5,737,947 | A * | 4/1998 | Ling | 70/63 |
| 6,526,786 | B1 * | 3/2003 | Kayoda | 70/56 |
| 6,708,534 | B1 * | 3/2004 | Ruan | 70/38 A |
| 6,834,519 | B1 * | 12/2004 | Yang | 70/58 |
| 7,086,258 | B2 * | 8/2006 | Fisher et al. | 70/278.7 |
| 2004/0226325 | A1 * | 11/2004 | Ling | 70/63 |
| 2005/0044903 | A1 * | 3/2005 | Ling et al. | 70/30 |
| 2005/0223758 | A1 * | 10/2005 | Yu | 70/63 |
| 2006/0137413 | A1 * | 6/2006 | Yu | 70/63 |
| 2006/0213237 | A1 * | 9/2006 | Yang | 70/63 |

* cited by examiner

*Primary Examiner*—Lloyd A Gall
(74) *Attorney, Agent, or Firm*—Browdy and Neimark, P.L.L.C.

(57) ABSTRACT

A lock includes a lock body, a shackle insertable into two insertion slots of the lock body, a slidable box movable into and out of an accommodation chamber of the lock body, a locking mechanism engageable with the shackle when the slidable box is moved into the accommodation chamber, and a combination lock unit mounted in the lock body and operable by the user to move a movable locking frame between a locking position and an unlocking position to lock and unlock the slidable box.

8 Claims, 6 Drawing Sheets

LOCK HAVING SLIDABLE BOX

BACKGROUND OF THE INVENTION

1. Field of the Invention

The present invention relates to locks and more particularly, to such a lock that has a slidable box for storing small things.

2. Description of the Related Art

Various kinds of locks have been developed, and have sold on the market. There is known a commercial lock, which comprises a lock body and a shackle. The lock body is openable and has an accommodation chamber defined therein. The shackle has a free end detachably fastened to the lock body to lock the lock to an object. Thus, the user can store important small personal things, such as key, card, or memo, in the accommodation chamber of the lock body and then lock the lock to the door handle or door frame. However, when the user unlocks the lock, the lock body may be directly opened, and the storage small personal things may fall out of the lock body, and the user may be not aware that the storage small personal things have lost. Further, the aforesaid conventional lock may be not easy to operate due to an environmental limitation. For example, in the narrow space between the door handle and the door plate the user may be unable to adjust the position or angle of the lock. In this case, it is difficult to take the storage small personal things from the lock body of the lock.

Therefore, it is desirable to provide a lock that eliminates the aforesaid drawbacks.

SUMMARY OF THE INVENTION

The present invention has been accomplished under the circumstances in view. It is therefore one objective of the present invention to provide a lock having a slidable box that is convenient to use.

To achieve this objective of the present invention, the lock comprises a lock body, a combination lock unit, a slidable box and a shackle. The lock body has an accommodation chamber, an opening in communication with the accommodation chamber, two insertion slots and a plurality of through holes. The combination lock unit is mounted inside the lock body and provided with a movable locking frame and a plurality of numbered rotating discs pivotally mounted inside the lock body and respectively peripherally protruding out of the through holes of the lock body for rotating by the user to move the movable locking frame between a locking position and an unlocking position. The slidable box is moveable into and out of the accommodation chamber through the opening of the lock body. The slidable box has a notch engageable with the movable locking frame when the movable locking frame is moved to the locking position. The shackle has two ends insertable into the insertion slots of the lock body and provided with at least one engagement portion engageable with the slidable box when the slidable box is received in the accommodation chamber of the lock body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
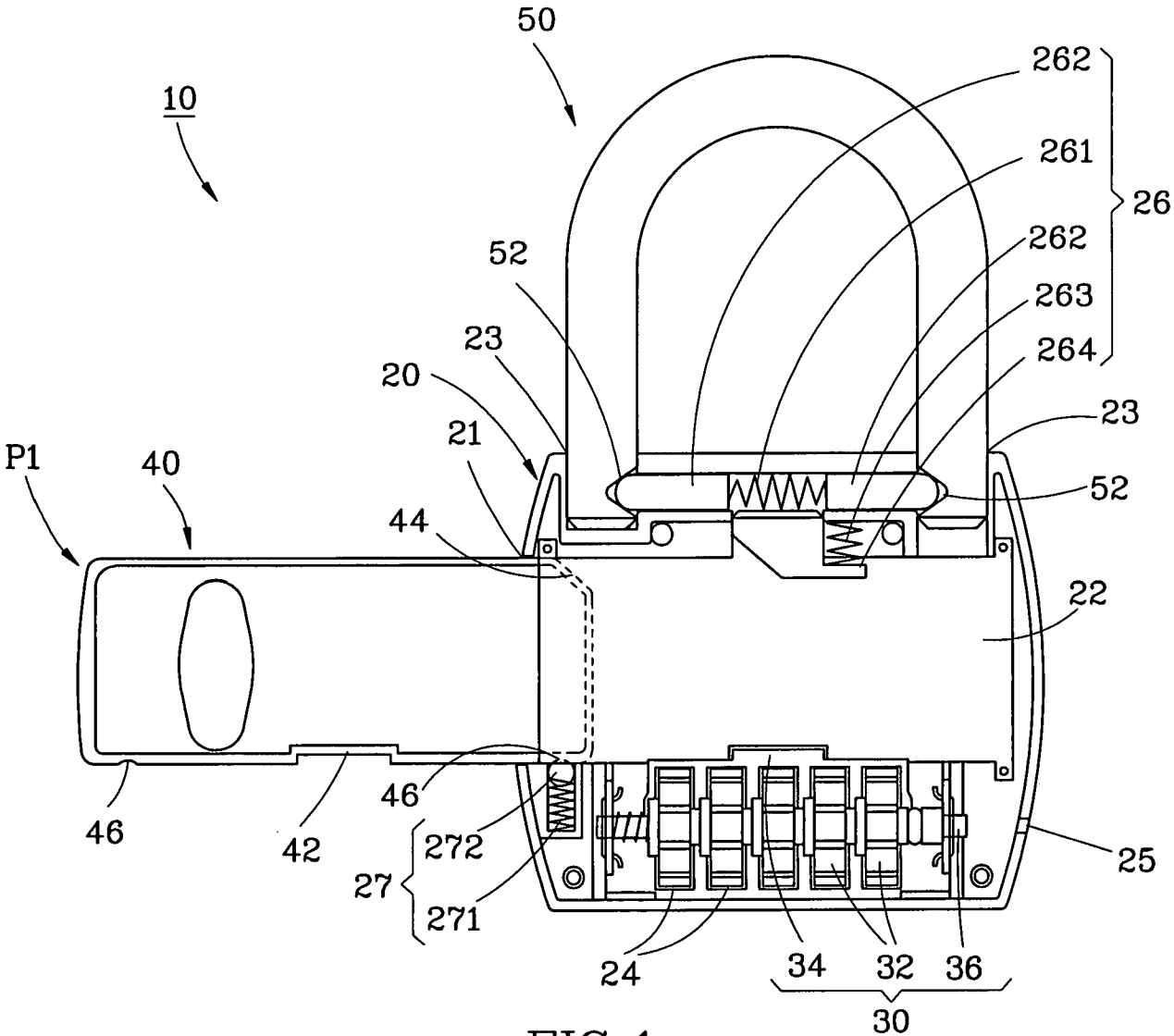
FIG. 1 is a schematic plane view of a lock in accordance with a first preferred embodiment of the present invention.
Figure 2:
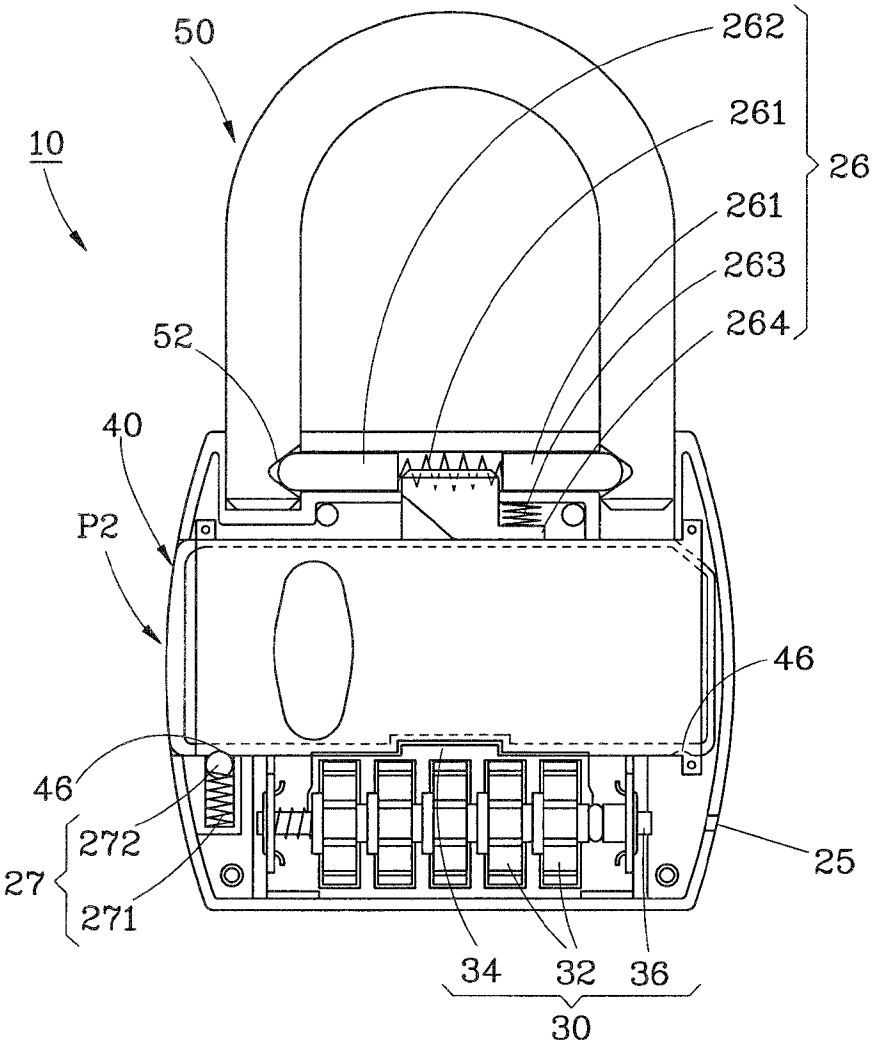
FIG. 2 is a schematic drawing of the first preferred embodiment of the present invention, showing that the lock is locked.

As shown in FIGS. 1 and 2, a lock 10 in accordance with a first preferred embodiment of the present invention comprises a lock body 20, a combination lock unit 30, a slidable box 40, and a shackle 50.

The lock body 20 has an opening 21, an accommodation chamber 22, two insertion slots 23, a plurality of through holes 24, a tool hole 25, a locking mechanism 26, and a locating device 27. The opening 21 is provided at one lateral side of the lock body 20 in communication between the accommodation chamber 22 and the atmosphere. The two insertion slots 23 are formed on the top side of the lock body 20. The through holes 24 cut through the front side of the lock body 20. The tool hole 25 is formed in the opposite lateral side of the lock body 20. The locking mechanism 26 is mounted in the top side of the lock body 20, comprising a first spring member 261, two lock pins 262, a second spring member 263, and a beveled sliding block 264. The two lock pins 262 are respectively stopped against the two distal ends of the first spring member 261 and movable axially relative each other to compress/release the first spring member 261. The second spring member 263 has two distal ends respectively stopped against the lock body 20 and the beveled sliding block 264. The beveled sliding block 264 is supported on one end of the second spring member 263, and movable in direction perpendicular to the moving direction of the lock pins 262. The locating device 27 is comprised of a spring member 271 and a ball 272. The spring member 271 is a coil spring stopped between the lock body 20 and the ball 272. The ball 272 is supported on one end of the spring member 271 and movable in the extending direction of the spring member 271 such that the ball 272 is stoppable at the lateral side of the slidable box 40.

The combination lock unit 30 is mounted in the lock body 20, comprising a set of numbered rotating discs 32, a movable locking frame 34, and a setting device 36. The numbered rotating discs 32 are pivotally mounted in the lock body 20 and respectively peripherally protruding out of the through holes 24 of the lock body 20 for rotating by the user to show a predetermined number combination. The movable locking frame 34 is movable by the numbered rotating discs 32 between an unlocking position P1 and a locking position P2 to lock/unlock the slidable box 40. The setting device 36 is aimed at the tool hole 25. Through the tool hole 25, the user can insert a tool to operate the setting device 36 to set the number combination that unlocks the combination lock unit 30. It is to be understood that the combination lock unit 30 is a prior art, which is extensively used in the market and well-known to a person skilled in the art; therefore, detailed structure of the combination lock unit 30 needs not to be described hereinafter.

The slidable box 40 is substantially a rectangular box insertable through the opening 21 into the accommodation chamber 22 of the lock body 20. The slidable box 40 has a notch 42, a bevel face 44, and two locating holes 46. The notch 42 is provided at one lateral side, namely, the first lateral side of the slidable box 40 for engagement with the movable locking frame 34 of the combination lock unit 30. The bevel face 44 is provided at the other lateral side, namely, the second lateral side of the slidable box 40 for pushing the beveled sliding block 264 of the lock body 20. The two locating holes 46 are formed on the first lateral side of the slidable box 40 for engagement with the ball 272 of the locating device 27 selectively, to hold the slidable box 40 in the extended position (see FIG. 1) or received position (see FIG. 2).

The shackle 50 is a U-bar, having two ends respectively inserted into the insertion slots 23 of the lock body 20 and two engagement portions, i.e., locating notches 52 respectively disposed near the two ends for receiving the lock pins 262 of the locking mechanism 26 respectively.

When the numbered rotating discs 32 of the combination lock unit 30 are rotated to show the set number combination, the movable locking frame 34 is moved to the unlocking position P1 where the notch 42 is disengaged from the movable locking frame 34. At this time, the slidable box 40 is movable in and out of the accommodation chamber 22 through the opening 21 between the extended position shown in FIG. 1 and the received position shown in FIG. 2. When the slidable box 40 is in the extended position shown in FIG. 1, the beveled sliding block 264 is pushed away from the space between the two lock pins 262 by the spring power of the second spring member 263, allowing axial movement of the lock pins 52 relative to each other and insertion of the ends of the shackle 50 into the insertion slots 23 of the lock body 20. After insertion of the two ends of the shackle 50 into the insertion slots 23 of the lock body 20, the lock pins 262 are forced by the first spring member 261 into engagement with the locating notches 52 of the shackle 50. At this time, the user can push the slidable box 40 into the inside of the accommodation chamber 22 of the lock body 20. When pushing the slidable box 40 from the extended position shown in FIG. 1 to the received position shown in FIG. 2, the bevel face 44 is forced against the beveled sliding block 264 to push the beveled sliding block 264 upwards into the space between the two lock pins 262. At this time, the two lock pins 262, which are respectively stopped by two ends of the beveled sliding block 264, can not move toward each other such that the lock pins 262 are firmly held in engagement with the locating notches 52 of the shackle 50 to lock the shackle 50 to the lock body 20. After the slidable box 40 has been moved to the received position inside the accommodation chamber 22 of the lock body 20, the numbered rotating discs 32 can be rotated to move the movable locking frame 34 to the locking position P2 where the movable locking frame 34 is held in engagement with the notch 42 of the slidable box 40 to lock the slidable box 40 to the lock body 20, as shown in FIG. 2.

Figure 3:
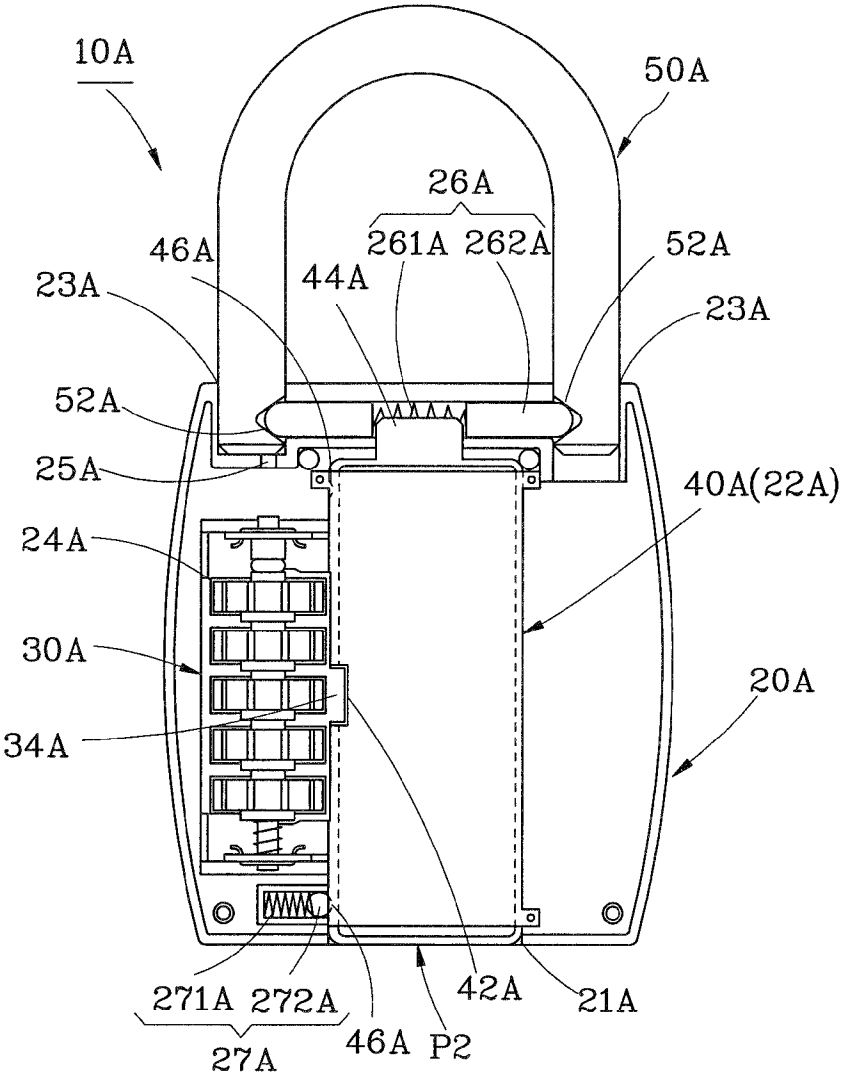
FIG. 3 is a schematic plane view of a lock in accordance with a second preferred embodiment of the present invention.

FIG. 3 illustrates a lock 10A in accordance with a second preferred embodiment of the present invention. According to this embodiment, the lock 10A is comprised of a lock body 20A, a combination lock unit 30A, a slidable box 40A, and a shackle 50A.

The lock body 20A has an opening 21A, an accommodation chamber 22A, two insertion slots 23A, a plurality of through holes 24A, a tool hole 25A, a locking mechanism 26A, and a locating device 27A. The locking mechanism 26A of the lock body 20A comprises a spring member 261A and two lock pins 262A. The two lock pins 262A are respectively stopped against the two distal ends of the spring member 261A and movable axially relative each other to compress/release the spring member 261A. The locating device 27A is similar to the locating device 27 of the aforesaid first embodiment of the present invention. The locating device 27A has a spring member 271A and a ball 272A. The spring member 271A is stopped between the lock body 20A and the ball 272A. The ball 272A is supported on one end of the spring member 271A. The combination lock unit 30A is similar to the combination lock unit 30 of the aforesaid first embodiment of the present invention.

The shackle 50A is a U-bar, having two ends respectively inserted into the insertion slots 23A of the lock body 20A and two locating portions, i.e., locating notches 52A respectively disposed near the two ends thereof for receiving the lock pins 262A of the locking mechanism 26A respectively. The slidable box 40A is a rectangular box insertable through the opening 21A into the accommodation chamber 22A of the lock body 20A.

The slidable box 40A has a notch 42A, a protrusion 44A, and two locating holes 46A. The notch 42A is provided at one lateral side of the slidable box 40A for engagement with the movable locking frame 34A of the combination lock unit 30A. The protrusion 44A is protruded from one end of the slidable box 40A for insertion into the space between the two lock pins 262A to keep the lock pins 262A be in engagement with the locating notches 52A of the shackle 50A. The two locating holes 46A are formed on the same lateral side of the slidable box 40A for engagement with the ball 272A of the locating device 27A selectively, to hold the slidable box 40A in the extended position or received position.

When the slidable box 40A is unlocked and extended out of the lock body 20A, the protrusion 44A is moved out of the space between the two lock pins 262A of the locking mechanism 26A, so that the shackle 50A can be inserted into or moved out of the insertion slots 23A of the lock body 20A. On the contrary, when the slidable box 40A is received in the accommodation chamber 22A of the lock body 20A and locked by the combination lock unit 30A, the protrusion 44A is engaged in between the lock pins 262A, holding the lock pins 262A in positive engagement with the locating notches 52A of the shackle 50A. Therefore, this second embodiment achieves the same effect as the aforesaid first embodiment of the present invention.

Figure 4:
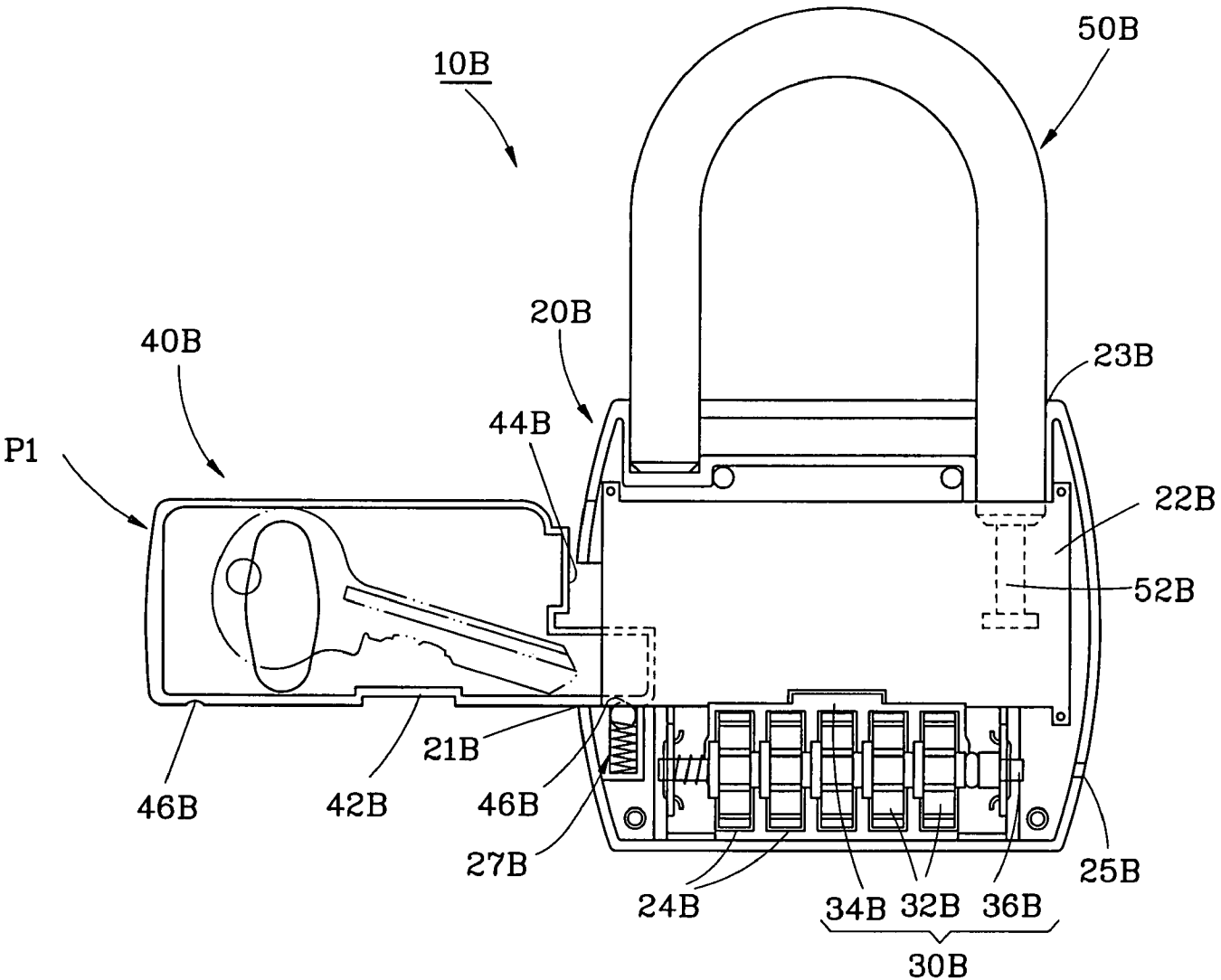
FIG. 4 is a schematic plane view of a lock in accordance with a third preferred embodiment of the present invention.
Figure 5:
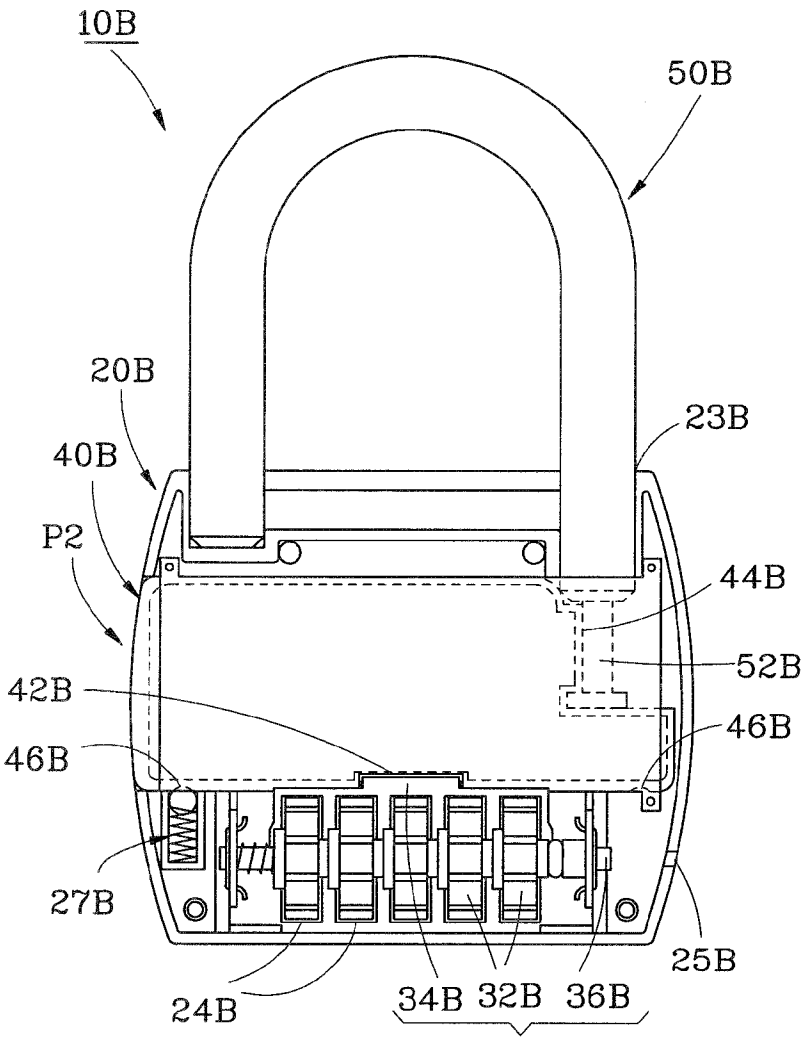
FIG. 5 is a schematic drawing of the third preferred embodiment of the present invention, showing that the lock is locked.

FIGS. 4 and 5 show a lock 10B in accordance with a third preferred embodiment of the present invention. Similar to the aforesaid first preferred embodiment, the lock 10B of this third preferred embodiment comprises a lock body 20B, a combination lock unit 30B, a slidable box 40B, and a shackle 50B.

The lock body 20B has an opening 21B, an accommodation chamber 22B, two insertion slots 23B, a plurality of through holes 24B, a tool hole 25B, and a locating device 27B.

The slidable box 40B is a rectangular container slidably inserted through the opening 21B into the accommodation chamber 22B, having a notch 42B, a protrusion 44B, and two locating holes 46B. The notch 42B is provided at one lateral side of the slidable box 40B for engagement with the movable locking frame 34B of the combination lock unit 30B. The protrusion 44B is protruded from one end of the slidable box 40B. The two locating holes 46B are provided at one lateral side of the slidable box 40B near the two ends of the slidable box 40B for engagement with the locating device 27B selectively.

The shackle 50B is a U-bar insertable with the two ends thereof into the two insertion slots 23B of the lock body 20B, having an engagement portion 52B at one end for engagement with the protrusion 46B of the slidable box 40B. According to this embodiment, the engagement portion 52B is an annular groove extending around the periphery of one end of the shackle 50B. This embodiment achieves the same effect as the aforesaid first and second embodiments.

Figure 7:
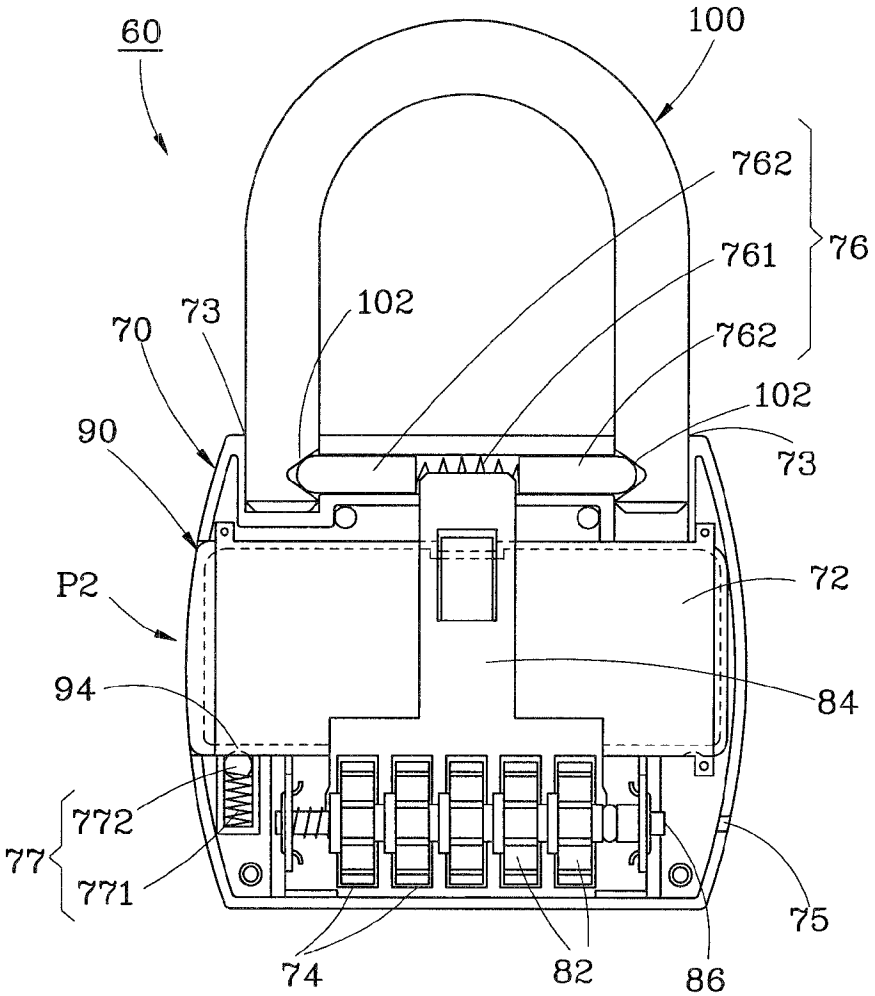
FIG. 7 is a schematic drawing of the fourth preferred embodiment of the present invention, showing that the lock is locked.
Figure 6:
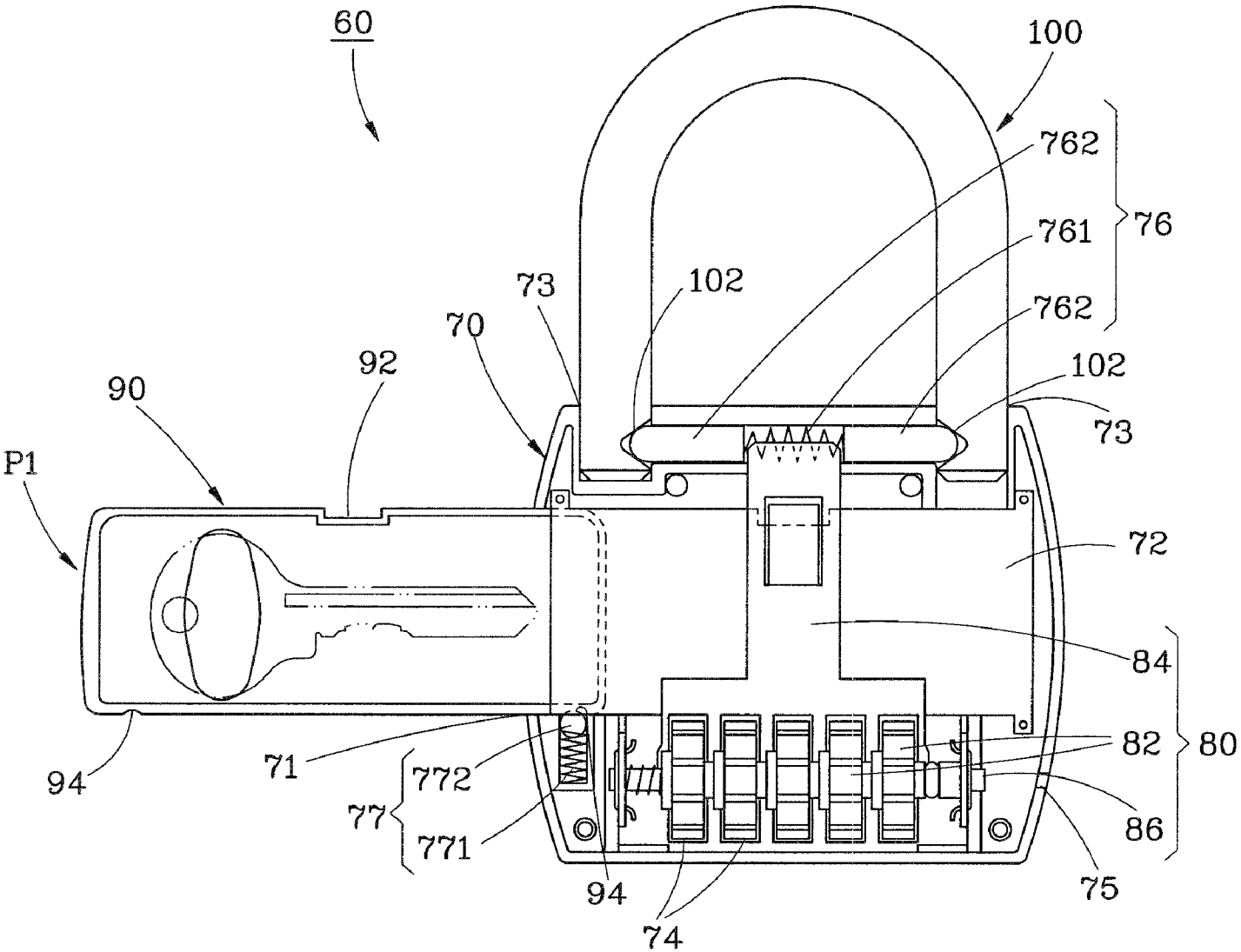
FIG. 6 is a schematic plane view of a lock in accordance with a fourth preferred embodiment of the present invention.

FIGS. 6 and 7 show a lock 60 in accordance with a fourth preferred embodiment of the present invention. According to this embodiment, the lock 60 comprises a lock body 70, a combination lock unit 80, a slidable box 90, and a shackle 100.

The lock body 70 has an opening 71, an accommodation chamber 72, two insertion slots 73, a plurality of through holes 74, a tool hole 75, a locking mechanism 76, and a locating device 77. The opening 71 is formed in one lateral side of the lock body 70 in communication between the accommodation chamber 72 and the atmosphere. The two insertion slots 73 are formed in the top side of the lock body 70. The tool hole 75 is formed in the other lateral side of the lock body 70. The locking mechanism 76 is comprised of a spring member 761 and two lock pins 762. The two lock pins 762 are respectively stopped against the two distal ends of the spring member 761 and axially movable relative to each other. The locating device 77 is comprised of spring member, for example, a coil spring 771, and a ball 772. The ball 772 is supported on the coil spring 771 and movable in the extending direction of the coil spring 771 for engaging the slidable box 90.

The combination lock unit 80 is mounted in the lock body 70, comprising a set of numbered rotating discs 82, a movable locking frame 84, and a setting device 86. The numbered rotating discs 82 are pivotally mounted in the lock body 70 and respectively peripherally protruding out of the through holes 74 of the lock body 70 for rotating by the user. The movable locking frame 84 is movable by the numbered rotating discs 82 between an unlocking position P1 and a locking position P2 to lock/unlock the slidable box 90. The setting device 86 is aimed at the tool hole 75. Through the tool hole 75, the user can insert a tool to operate the setting device 86 to set the number combination that unlocks the combination lock unit 80.

The slidable box 90 is a rectangular box insertable through the opening 71 into the accommodation chamber 72 of the lock body 70. The slidable box 90 has a notch 92 and two locating holes 94. The notch 92 is provided at one lateral side of the slidable box 90 for engagement with the movable locking frame 84 of the combination lock unit 80. The two locating holes 94 are formed on the other lateral side of the slidable box 40 for engagement with the ball 772 of the locating device 77 selectively, to hold the slidable box 90 in the extended position or received position.

The shackle 100 is a U-bar, having two ends respectively inserted into the insertion slots 73 of the lock body 70 and two engagement portions, i.e., locating notches 102 respectively disposed near the two ends for receiving the lock pins 762 of the locking mechanism 76 respectively.

When the numbered rotating discs 82 of the combination lock unit 80 are rotated to show the set number combination, the movable locking frame 44 is moved to the unlocking position P1 where the movable locking frame 84 is disengaged from lock pins 762 of the locking mechanism 76 and the notch 92 of the slidable box 90. At this time, the slidable box 90 is movable in and out of the accommodation chamber 72 through the opening 71, and the two ends of the shackle 100 are insertable into the insertion slots 73 of the lock body 70. When inserted the shackle 100 into the insertion slots 73 of the lock body 70 at this time, the shackle 100 is not locked, and movable in and out of the lock body 70.

When the slidable box 90 is moved into the inside of the accommodation chamber 72 of the lock body 70, the numbered rotating discs 84 can be rotated to move the movable locking frame 84 to the locking position P2. At this time, the movable locking frame 84 is forced into engagement with the notch 92 of the slidable box 90, and partially extends into the space between the two lock pins 762 to support the lock pins 762 in engagement with the locating notches 102 of the shackle 100, thereby locking the slidable box 90 and the shackle 100 to the lock body 70.

According to this embodiment, the slidable box 80 and the shackle 100 are separately operable, i.e., when the movable locking frame 84 is in the unlocking position P1, the slidable box 80 and the shackle 100 can be separately operated (see FIG. 6), and the user can open the slidable box 90 to take the storage things out of the slidable box 90 without dismounting the lock 60. When the movable locking frame 84 of the combination lock unit 80 is in the locking position P2, the movable locking frame 84 simultaneously locks the shackle 100 and the slidable box 90 (see FIG. 7). Therefore, when comparing to the prior art design, the lock 60 is convenient to use.

This fourth preferred embodiment is substantially similar to the aforesaid first embodiment of the present invention with the exception that the movable locking frame 84 is used to lock the slidable box 90 and the shackle 100 at the same time, i.e., the movable locking frame 84 directly locks the shackle 100. According to the aforesaid first embodiment, the movable locking frame 34 of the combination lock 30 is used to lock the sliding block 40, causing the sliding block 40 to lock the shackle 50, i.e., the movable locking frame 34 locks the shackle 50 indirectly. These two embodiments use the same technical measure.

Figure 8:
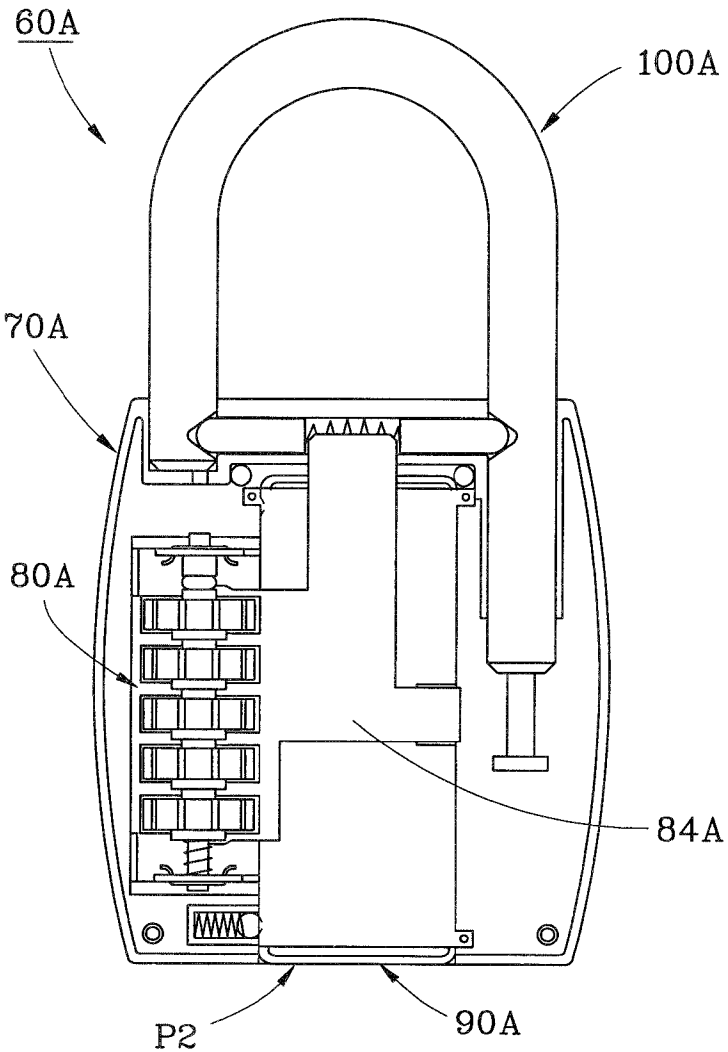
FIG. 8 is a schematic plane view of a lock in accordance with a fifth preferred embodiment of the present invention.

FIG. 8 shows a lock 60A in accordance with a fifth preferred embodiment of the present invention. The structure of this fifth embodiment is substantially similar to the aforesaid fourth embodiment. According to this embodiment, the lock 60A comprises a lock body 70A, a combination lock unit 80A, a slidable box 90A, and a shackle 100A. The slidable box 90A of this fifth embodiment is movable in and out of the lock body 70A in a different direction relative to the moving direction of the slidable box 90 of the aforesaid fourth embodiment. Same as the aforesaid fourth embodiment of the present invention, the movable locking frame 84A of the combination lock 80 of the lock 60A of this fifth embodiment is used to lock the slidable box 90A and the shackle 100A directly at the same time.

Figure 9:
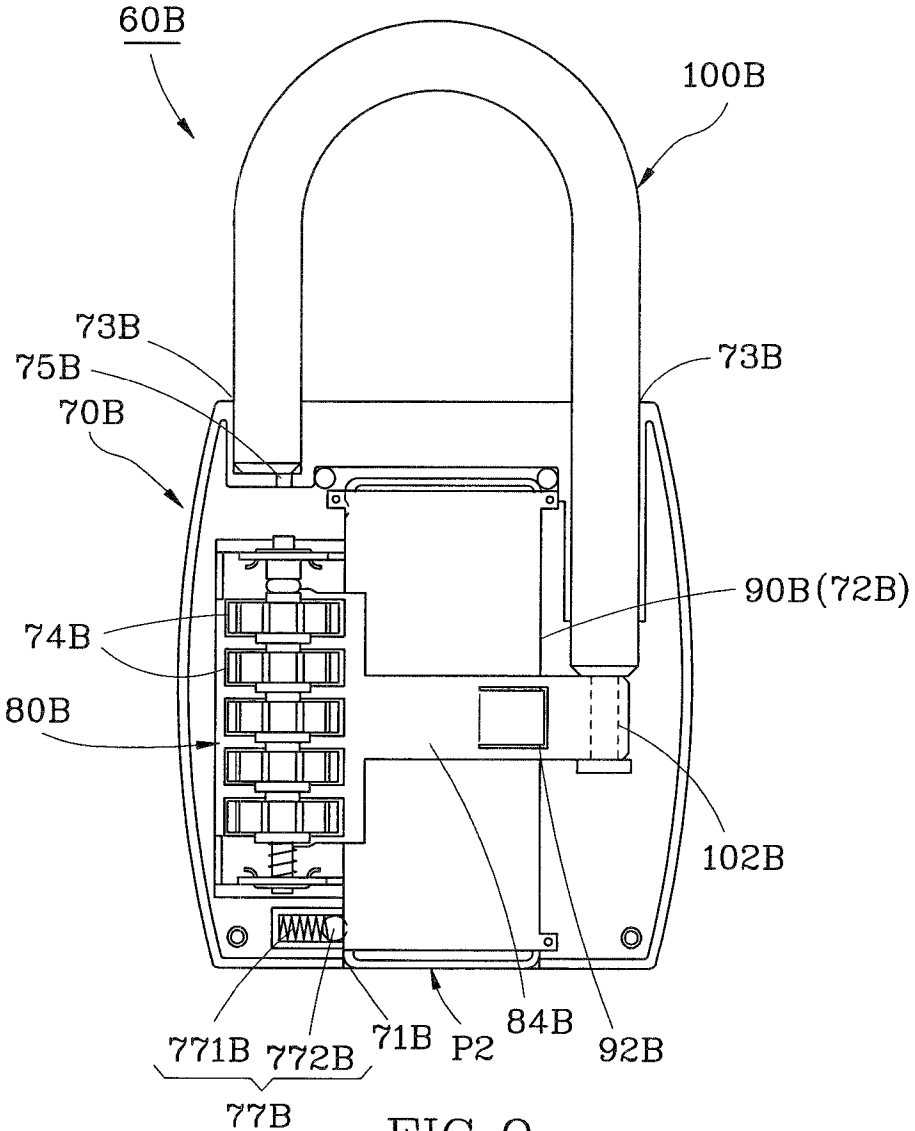
FIG. 9 is a schematic plane view of a lock in accordance with a sixth preferred embodiment of the present invention.

FIG. 9 shows a lock 60B in accordance with a sixth preferred embodiment of the present invention. Similar to the aforesaid fourth embodiment of the present invention, the lock 60B comprises a lock body 70B, a combination lock unit 80B, a slidable box 90B, and a shackle 100B.

The lock body 70B has an opening 71B, an accommodation chamber 72B, two insertion slots 73B, a plurality of through holes 74B, a tool hole 75B, and a locating device 77B. The accommodation chamber 72B is defined in the lock body 70B. The opening 71B is formed in one side of the lock body 70B in communication between the accommodation chamber 72B and the atmosphere. The two insertion slots 73B are respectively formed in the top side of the lock body 70B. The through holes 74B are respectively formed in the front side of the lock body 70B. The tool hole 75B is formed in one lateral side of the lock body 70B. The locating device 77B comprises a spring member, for example, a coil spring 771B mounted inside the lock body 70B, and a ball 772B supported on the coil spring 771B and movable in the extending direction of the coil spring 771B and adapted to engage one lateral side of the slidable box 90B.

The shackle 100B is a U-bar, having two ends respectively insertable into the two insertion slots 73B of the lock body 70B and an engagement portion, for example, an annular groove 102B extending around the periphery of one end for engagement with the movable locking frame 84B of the combination lock unit 80B.

According to this sixth embodiment, the movable locking frame 84B of the combination lock unit 80B engages the engagement portion 102B of the shackle 100B and the notch 92B of the slidable box 90B, thereby locking the shackle 100B and the slidable box 90B to the lock body 70B directly at the same time. Therefore, this sixth embodiment achieves the same effect as the aforesaid fourth embodiment of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lock comprising:

a lock body having an accommodation chamber, an opening in communication with the accommodation chamber, two insertion slots, and a plurality of through holes;

a combination lock unit mounted inside the lock body, the combination lock unit having a movable locking frame and a plurality of numbered rotating discs pivotally mounted inside the lock body and respectively peripherally protruding out of the through holes of the lock body for rotating by the user to move the movable locking frame between a locking position and an unlocking position;

a slidable box moveable into and out of the accommodation chamber through the opening of the lock body, the slidable box having a notch engageable with the movable locking frame when the movable locking frame is moved to the locking position; and a shackle having two ends insertable into the insertion slots of the lock body and provided with at least one engagement portion engageable in the lock body;

wherein the at least one engagement portion of said shackle is a groove extending around a periphery of one of the two end of said shackle; and wherein said slidable box has a protrusion at one end thereof, which is engageable with the at least one engagement portion of said shackle in the lock body.

2. The lock as claimed in claim 1, wherein said slidable box has at least one locating hole; said lock body comprises a locating device having a spring member and a ball supported on the spring member for engaging the at least one locating hole of said slidable box to hold said slidable box in place.

3. The lock as claimed in claim 1, wherein said combination lock unit comprises a setting device for setting a predetermined number combination of said combination lock unit that unlocks said combination lock unit; wherein said lock body has a tool hole aimed at the setting device for the insertion of a tool by the user to operate the setting device of said combination lock unit.

4. The lock as claimed in claim 1, wherein said combination lock unit comprises a setting device for setting a predetermined number combination of said combination lock unit that unlocks said combination lock unit; wherein said lock body has a tool hole aimed at the setting device for the insertion of a tool by the user to operate the setting device of said combination lock unit.

5. A lock comprising:

a lock body having an accommodation chamber, an opening in communication with the accommodation chamber two insertion slots, and a plurality of through holes;

a combination lock unit mounted inside the lock body, the combination lock unit having a movable locking frame and a plurality of numbered rotating discs pivotally mounted inside the lock body and respectively peripherally protruding out of the through holes of the lock body for rotating by the user to move the movable locking frame between a locking position and an unlocking position;

a slidable box moveable into and out of the accommodation chamber through the opening of the lock body, the slidable box having a notch engageable with the movable locking frame when the movable locking frame is moved to the locking position;

a shackle having two end insertable into the insertion slots of the lock body and provided with two engagement portion engageable in the lock body;

a locking mechanism mounted inside said lock body and controllable by said slidable box to engage the two engagement portions of said shackle to lock said shackle to said lock body; and wherein the locking mechanism comprises a first spring member and two lock pins respectively supported on two distal ends of said first spring member, movable axially relative to each other and engageable with the two engagement portions of said shackle respectively.

6. The lock as claimed in claim 5, wherein said slidable box has a protrusion on a side thereof, said protrusion being engageable between said two lock pins of said locking mechanism to move said lock pins to engage with the engagement portions of said shackle when said slidable box is received inside said accommodation chamber.

7. The lock as claimed in claim 5, wherein said slidable box has a bevel face; said locking mechanism further comprises a second spring member mounted inside said lock body, and a sliding block supported on said second spring member and movable by said bevel face of said slidable box into engagement between said two lock pins to hold said lock pins to engage with the two engagement portions of said shackle.

8. The lock as claimed in claim 5, wherein said slidable box has at least one locating hole; said lock body comprises a locating device having a spring member and a ball supported on the spring member for engaging the at least one locating hole of said slidable box to hold said slidable box in place.

* * * * *